US005256999A

United States Patent [19]

Utsugi et al.

[11] Patent Number: 5,256,999

[45] Date of Patent: Oct. 26, 1993

[54] THREAD TYPE MAGNETIC CORE STRUCTURE

[75] Inventors: Shoichi Utsugi; Yasunori Mamiya; Tatsushi Shinoda, all of Tsurugashima, Japan

[73] Assignee: Tokyo Kabushiki Kaisha, Tokyo, Japan

[21] Appl. No.: 923,627

[22] Filed: Aug. 3, 1992

[30] Foreign Application Priority Data

Aug. 9, 1991 [JP] Japan ..... 3-071183[U]
Oct. 25, 1991 [JP] Japan ..... 3-095849[U]

[51] Int. Cl.[5] ..... H01F 21/06
[52] U.S. Cl. ..... 336/136
[58] Field of Search ..... 336/136, 130, 83, 233

[56] References Cited

U.S. PATENT DOCUMENTS 2,318,415 5/1943 Patzsehke et al. ..... 336/136
3,177,730 4/1965 Sanger et al. ..... 336/136
3,182,516 5/1965 Rapata ..... 336/136
3,218,695 11/1965 Fisher ..... 336/136
4,115,840 9/1978 Horton ..... 336/136

*Primary Examiner*—Thomas J. Kozma
*Attorney, Agent, or Firm*—Cushman, Darby & Cushman

[57] ABSTRACT

A thread type magnetic core structure, including: a magnetic core having a thread formed on the outer surface of the core; and a resin structure of a rod type fixedly mounted on one end surface of the magnetic core in the longitudinal direction of the core, the resin structure having an engaging member at the top portion of the resin structure, and the engaging member being adapted to couple to a driver for rotating the magnetic core, wherein the engaging member is formed in a polygonal shape in section including a triangle, and the outer periphery of the resin structure having the polygonal engaging member is set within the circumference of the magnetic core.

2 Claims, 2 Drawing Sheets

THREAD TYPE MAGNETIC CORE STRUCTURE

BACKGROUND OF THE INVENTION

Field of the Invention

The present invention relates to a thread type magnetic core structure to be mounted on a bobbin of a high frequency coil.

Description of the Related Background Art

FIG. 9 is a cross sectional view showing an example of a variable inductance high frequency coil. A thread type magnetic core 3 is threaded with a bobbin 2 at the center thereof, the bobbin 2 having a coil 1 wound about it. The inductance of the coil 1 is adjusted by rotating the core 3 up and down within the bobbin 2, by using a screwdriver. Reference numeral 4 represents a groove to which a screwdriver couples, reference numeral 5 represents a shielding case, and reference numeral 6 represents a terminal.

The conventional thread type magnetic core 3 has been found unsatisfactory, however, in that it is not suited for high frequency coils whose inductance is adjusted automatically by using mechanical apparatuses.

In the mechanical adjustment, a large force is applied to a thread type magnetic core in the longitudinal direction thereof, as opposed to manual adjustment. Therefore, while rotating the core with a screwdriver, an accident of breaking the core is likely to occur.

Furthermore, a so-called backlash phenomenon may occur so that the adjusted inductance will shift to a different value when a screwdriver is decoupled from the thread type magnetic core 3. This phenomenon occurs from the following reason. During the inductance adjustment, a large force is applied via the thread type magnetic core 3 to the bobbin 2 at the threading portion to slightly deform this portion. After the inductance adjustment, the screwdriver is decoupled from the magnetic core 3 and the deformation is released so that the position of the magnetic core 3 shifts from the original position.

Another problem is also known that high frequency coils without any inductance adjustment are found at the manufacturing line. The reason for this is that a flat-blade or cross-blade screwdriver cannot be coupled to the groove formed at one end of the magnetic core for the purpose of the inductance adjustment, because the groove is small in extent and it is difficult to be located by an apparatus for operating the screwdriver. In a particular case wherein a high frequency coil is set to the adjustment position in a slightly inclined posture, the precise position of the groove of a thread type magnetic core is difficult to be detected, and such a problem is likely to occur.

SUMMARY OF THE INVENTION

It is an object of the present invention to provide a thread type magnetic core structure suitable for use with high frequency coils or the like whose inductance is automatically adjusted by using mechanical apparatuses.

According to one aspect of the present invention, there is provided a thread type magnetic core structure which comprises: a magnetic core having a thread formed on the outer surface of the core; and a resin structure of a rod type fixedly mounted on one end surface of the magnetic core in the longitudinal direction of the core, the resin structure having an engaging member at the top portion of the resin structure, and the engaging member being adapted to couple to a driver for rotating the magnetic core, wherein the engaging member is formed in a polygonal shape in section including a triangle, and the outer periphery of the resin structure having the polygonal engaging member is set within the circumference of the magnetic core.

DETAILED DESCRIPTION OF THE PREFERRED EMBODIMENTS

A first embodiment of a thread type magnetic core structure according to the present invention will be described with reference to FIGS. 1 to 4.

Figure 1:
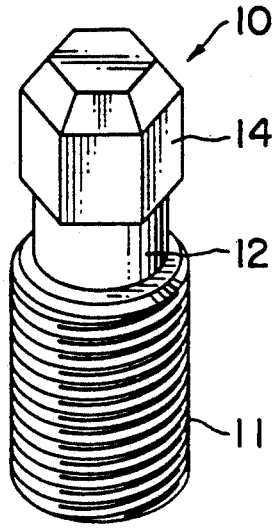
FIG. 1 is a perspective view showing a first embodiment of a thread type magnetic core structure according to the present invention.
Figure 2:
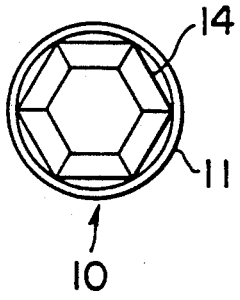
FIGS. 2, 3 and 4 are plan, bottom and cross sectional views respectively of the thread type magnetic core structure shown in FIG. 1.
Figure 3:
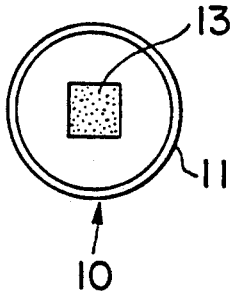
Figure 4:
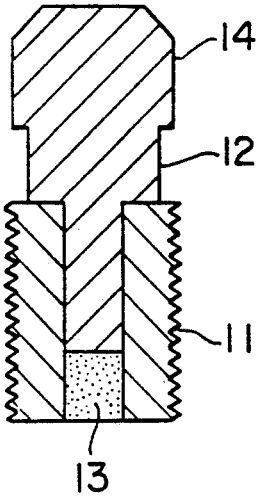

FIG. 1 is a perspective view of the thread type magnetic core, FIGS. 2, 3 and 4 are the plan, bottom and cross sectional views of the core, respectively.

A thread type core structure 10 is constructed of a magnetic core 11 having a thread formed on the outer surface thereof, and a resin structure 12 of a rod type fixedly mounted on the top of the magnetic core 11.

As particularly shown in FIG. 4, the resin structure 12 is partially inserted into a through hole formed in the core 11 at the center thereof, and fixedly attached to the core by using adhesive agent 13.

The top portion of the resin structure 12 is hexagonal in section. This hexagonal portion forms an engaging member 14 to which a hexagonal driver is coupled for the rotation of the core 11. The hexagonal portion is tapered at its distal portion to facilitate the coupling of the hexagonal driver to the resin structure 12. The lower portion of the resin structure 12 is circular in section, the diameter being smaller than the outer diameter of the magnetic core 11.

The magnetic core 11 is made of ferrite, or synthetic resin containing ferrite.

The outer periphery of the engaging member 14 is flush with the circumference of the magnetic core 11, as shown in FIG. 2.

The engaging member 14 of the resin structure 12 has a larger dimension than that of a conventional groove to which a flat-blade screwdriver is coupled. Therefore, it is easy to locate the engaging member 14 and ensure a reliable coupling of a driver to the engaging member 14.

Furthermore, the driver couples to the engaging member 14 at its surface area for the rotation of the thread type magnetic core 11. Therefore, a force in the longitudinal direction of the magnetic core structure 10 will not be applied, and the inductance of a coil will not change after the driver decouples from the engaging member 14.

Still further, the outer periphery of the engaging member 14 is flush with the circumference of the magnetic core 11 and does not protrude outside of the circumference. Therefore, it is not necessary to change the dimension of a mechanism which is used for mounting a thread type magnetic core on a high frequency coil.

Figure 10:
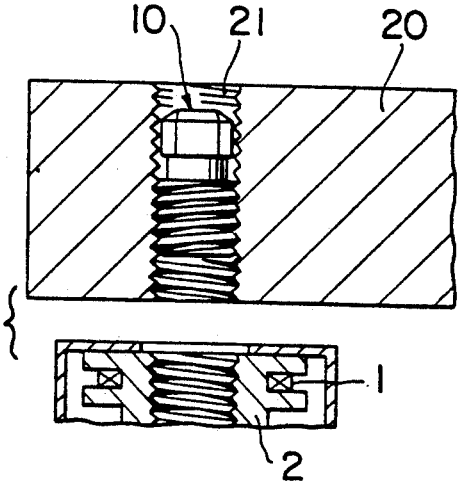
FIG. 10 is a cross sectional view of a mechanism for mounting a thread type magnetic coil structure on a high frequency coil.

FIG. 10 shows an example of such a mechanism for mounting a thread type magnetic core on a high frequency coil. As shown in FIG. 10, a thread type magnetic core structure 10 is put into a through hole 21 of a mechanism 20 and fitted onto a bobbin 2 of a high frequency coil positioned under the through hole 21. Since the through hole 21 of the mechanism 20 has an inner diameter same as conventional, it is not necessary to change the dimension of the mechanism 20 in fitting the thread type magnetic core structure 10 onto the bobbin 2.

It is not necessary that the outer periphery of the engaging member 14 be precisely flush with the circumference of the magnetic core 11, but it is sufficient if the outer periphery of the engaging member 14 is set within the circumference of the magnetic core 11.

Figure 5:
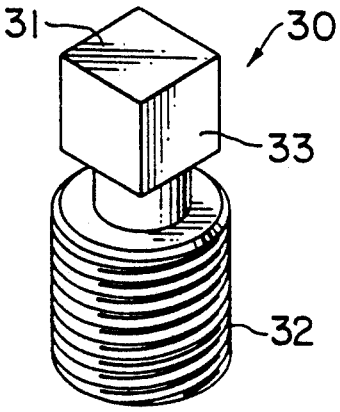
FIG. 5 is a perspective view showing a second embodiment of the thread type magnetic core structure according to the present invention.
Figure 6:
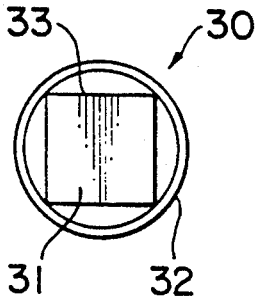
FIG. 6 is a plan view of the magnetic core structure shown in FIG. 5.

FIGS. 5 and 6 are a perspective view and plan view showing a second embodiment of the thread type magnetic core structure according to the present invention.

A thread type magnetic core structure 30 has an engaging member 33 at the top tetragonal portion of a resin structure 31. The outer periphery of the tetragonal engaging member 33 is flush with the circumference of the magnetic core 32, as shown in FIG. 6.

In the most desirable case, the shape of the engaging member takes a hexagon because a driver is generally formed in a hexagonal shape. However, the shape of the engaging member is not limited only to a hexagon, but it may take any other polygons including a triangle.

Figure 7:
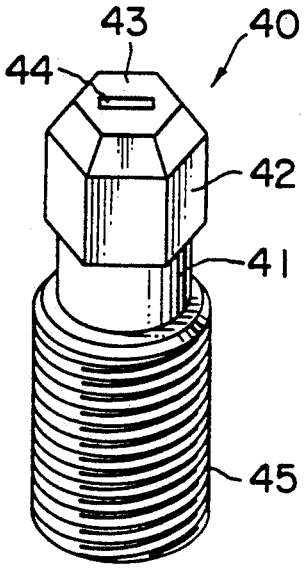
FIG. 7 is a perspective view showing a third embodiment of the thread type magnetic core structure according to the present invention.

FIG. 7 is a perspective view showing a third embodiment of the thread type magnetic core structure according to the present invention.

A thread type magnetic core structure 40 of this embodiment has substantially the same shape as that of the magnetic core member 10 of the first embodiment. However, the hexagonal engaging member 42 of a resin structure 41 has a linear groove 44 formed on the top 43 of the resin structure 41. Reference numeral 45 represents a magnetic core.

The linear groove 44 is provided in order to use a flat-blade screwdriver at the initial stage of fitting the core structure 40 onto a bobbin.

A flat-blade screwdriver is used at the initial stage, as described below, of fitting the core structure 40 onto a bobbin.

Namely, a hexagonal driver cannot be inserted into the through hole 21 to rotate the core structure 40, because the inner diameter of the hole 21 of the mechanism 20 is substantially the same as the outer diameter of the core structure 40 as shown in FIG. 10 so as to enter the core structure 40 straightly down into the hole 21 toward the bobbin 2.

In this case, if the core structure 40 is difficult to be fitted onto the bobbin 2, a flat-blade screwdriver is used only at the initial stage to rotate the core structure 40 and properly fit it onto the bobbin 2.

It is to be noted that if the technical problem described above does not exist, the groove 44 is not necessary.

Figure 8:
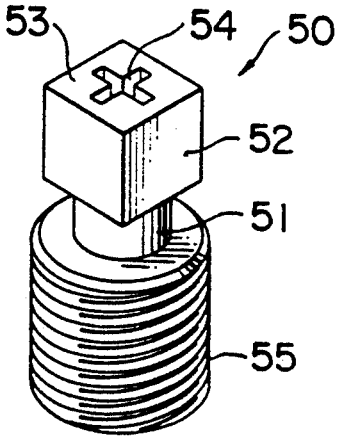
FIG. 8 is a perspective view showing a fourth embodiment of the thread type magnetic core structure according to the present invention.
Figure 9:
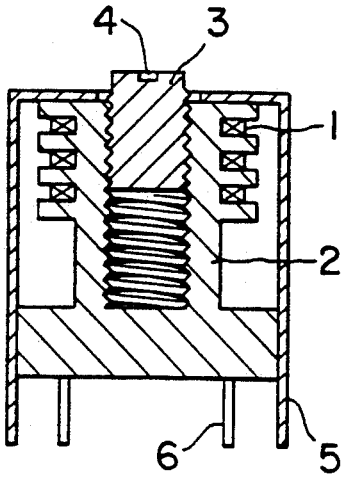
FIG. 9 (PRIOR ART)
FIG. 9 is a cross sectional view of a high frequency coil.

FIG. 8 is a perspective view of a fourth embodiment of the thread type magnetic core structure according to the present invention.

A thread type magnetic core structure 50 of this embodiment has substantially the same shape as that of the magnetic core member 30 of the second embodiment. However, the tetragonal engaging member 52 of a resin structure 51 has a cross groove 54 formed on the top 53 of the resin structure 51. Reference numeral 55 represents a magnetic core.

The cross groove 54 is provided also in order to use a cross-blade screwdriver at the initial stage of fitting the core structure 50 into a bobbin 2.

The shape of the bottom portion under the engaging member of the resin structure is not limited to the above-described embodiments. The lower portion of the resin structure under the engaging member may be cut off and the engaging member is directly placed upon the magnetic core.

It is apparent that the thread type magnetic core structure of this invention is applicable to high frequency coils of the type that a core structure is threaded with a bobbin. The present invention is applicable not only to high frequency coils but also to intermediate frequency transformers having a capacitor.

As described above, the thread type magnetic core structure of the present invention is constructed of a magnetic core and a resin structure having a polygonal engaging member to which a driver is coupled. The outer periphery of the resin structure inclusive of the engaging member is set within the circumference of the magnetic cores.

Since a driver is coupled to the resin structure, the magnetic core will not be broken while rotating it.

Since the contact area of the engaging member with a driver is large, the engaging member can be located easily by using a proper apparatus, thereby reliably coupling a driver to the engaging member.

Furthermore, a driver couples to the engaging member at its surface area without applying a force in the longitudinal direction of the magnetic core structure, so that the inductance of a coil will not change after the driver decouples from the engaging member.

Still further, the magnetic core member having the same size as conventional can be used, so that a conventional mechanism for mounting a thread type magnetic core member on a high frequency coil can be used without changing its dimension. Thus, it is advantageous to lessen the cost which might be caused by changing the mechanism due to the change of magnetic core member.

What is claimed is:

1. A thread type magnetic core structure, comprising:

a magnetic core having a thread formed on the outer surface of said core;

a resin structure of a rod type fixedly mounted on one end surface of said magnetic core in the longitudinal direction of said core, and an engaging member provided at the top portion of said resin structure, said engaging member being adapted to couple to a driver for rotating said magnetic core, wherein said engaging member is formed in a polygonal shape in section including a triangle, and the outer periphery of said resin structure having said polygonal engaging member is set within the circumference of said magnetic core.

2. A thread type magnetic core structure according to claim 1, wherein one of a linear groove or a cross groove is formed on the top of said resin structure.

* * * * *

UNITED STATES PATENT AND TRADEMARK OFFICE

CERTIFICATE OF CORRECTION

PATENT NO. : 5,256,999
DATED : October 26, 1993
INVENTOR(S) : UTSUGI et al.

It is certified that error appears in the above-indentified patent and that said Letters Patent is hereby corrected as shown below:

ON THE COVER PAGE:

Reads: [73] Assignee: Tokyo Kabushiki Kaisha, Tokyo, Japan

Should Read: [73] Assignee: Toko Kabushiki Kaisha, Tokyo, Japan

Signed and Sealed this

Second Day of May, 1995

Bruce Lehman

*Attest:*

BRUCE LEHMAN

*Attesting Officer*

*Commissioner of Patents and Trademarks*